US005471758A

United States Patent [19]

White, Sr.

[11] Patent Number: 5,471,758

[45] Date of Patent: Dec. 5, 1995

[54] TILE MEASURING DEVICE FOR USE IN LAYING TILES AND METHOD THEREFOR

[76] Inventor: Dennis P. White, Sr., 4104 E. Broadway, #1177, Mesa, Ariz. 85206

[21] Appl. No.: 262,954

[22] Filed: Jun. 21, 1994

[51] Int. Cl.[6] ..... B43L 7/12

[52] U.S. Cl. ..... 33/527; 33/DIG. 20; 33/469

[58] Field of Search ..... 33/526, 527, DIG. 20, 33/419, 467, 468, 469, 470, 472

[56] References Cited

U.S. PATENT DOCUMENTS

| | | | |
|---|---|---|---|
| 1,346,409 | 7/1920 | Lucas | 33/473 |
| 1,619,091 | 3/1927 | Rieser | 33/DIG. 20 |
| 2,770,043 | 11/1956 | Kwiecinski | 33/DIG. 20 |
| 4,899,455 | 2/1990 | Bovino et al. | 33/DIG. 20 |
| 5,131,164 | 7/1992 | Miller | 33/427 X |
| 5,181,326 | 1/1993 | Eberline | 33/DIG. 20 |
| 5,205,045 | 4/1993 | Liu | 33/DIG. 20 |

FOREIGN PATENT DOCUMENTS

| | | | |
|---|---|---|---|
| 1961169 | 8/1970 | Germany | 33/527 |

*Primary Examiner*—Alvin Wirthlin
*Attorney, Agent, or Firm*—Harry M. Weiss; Jeffrey D. Moy

[57] ABSTRACT

A tile measuring device for use in laying tiles is disclosed comprising a support member, a reference member portion, and a measuring member portion. The reference member portion is slidably coupled to the support member for establishing a reference position for the device with respect to a tile and second tile. The measuring member portion is movably coupled to the support member at a distal end thereof for defining a portion for removal from the second tile relative to the reference position. Removal of this undesired portion from the second tile permits the second tile to fit properly adjacent an obstruction after the undesired portion is removed.

16 Claims, 2 Drawing Sheets

TILE MEASURING DEVICE FOR USE IN LAYING TILES AND METHOD THEREFOR

BACKGROUND OF THE INVENTION

1. Field of the Invention

This invention relates generally to measuring devices and, more specifically, to a tile measuring device for use in laying tiles and a method therefor.

2. Description of the Related Art

Laying floor tiles is a timely and arduous process. One of the most time consuming steps in laying tiles is the step of custom cutting tiles to fit properly adjacent an obstruction such as a cabinet or a wall.

Typically, floor tilers accomplished custom tile cuts in the following general manner. After laying standard, un-cut tiles over the majority of the floor space of a room, a tiler would need to custom cut standard tiles to fit properly adjacent an obstruction such as a wall. The tiler would use a measuring tape to determine what portion would need to be cut from a standard tile such that the new, custom tile would fit properly adjacent both the wall and any adjacent tiles. Frequently, after completing all of the required measuring and cutting, a tiler discovers that the new, custom tile does not fit properly. This problem is caused by a number of factors such as poor measuring and/or cutting.

Up until now, there has not been a device for quickly, accurately, and easily measuring a standard tile for removing unwanted portions therefrom such that the new, custom tile would fit properly adjacent both an obstruction and any adjacent tiles.

SUMMARY OF THE INVENTION

In accordance with one embodiment of this invention, it is an object of this invention to provide a measuring device.

It is another object of this invention to provide a tile measuring device for use in laying tiles.

It is a further object of this invention to provide a method for tile measurement for use in laying tiles.

It is yet another object of this invention to provide a tile measuring device for quickly, accurately, and easily defining a portion of a tile for removal from the tile such that the tile, after having a portion thereof removed, fits properly adjacent an obstruction.

BRIEF DESCRIPTION OF THE PREFERRED EMBODIMENTS

In accordance with one embodiment of this invention, a tile measuring device for use in laying tiles is disclosed comprising, in combination, a support member, reference means slidably coupled to the support member for establishing a reference position for the device with respect to a tile and another tile, and measuring means movably coupled to the support member at a distal end thereof for defining a portion of the other tile relative to the reference position and for permitting the other tile to fit properly adjacent an obstruction after the portion is removed. The reference means is slidable from a proximate end of the support member substantially to the distal end of the support member. Additionally, the reference means further comprises means for fixedly retaining the reference means to the support member at any point from the proximate end substantially to the distal end of the support member. The reference means further comprises a horizontal member portion located substantially orthogonal to the support member and having a slot therein, and spacer bar means extending from the horizontal member portion for insertion between an edge of the tile and an edge of the other tile. The reference means further comprises gage member means slidably retained within the slot for extension from the horizontal member portion, and gage member retaining means coupled to the horizontal member portion for locking the gage member means in place. The slot is provided on a bottom side of the horizontal member portion and the slot extends along the full length of the horizontal member portion. The gage member means is extendable from both a first end and a second end of the horizontal member portion. The measuring means further comprises guide member means for alignment with the obstruction, and rotatable clamping means pivotally coupled to the support member for slidably retaining the guide member means and for rotating the guide member means for the alignment with the obstruction. The rotatable clamping means further comprises means for fixedly retaining the rotatable clamping means with the support member, and means for fixedly retaining the guide member means with the rotatable clamping means.

In accordance with another embodiment of this invention, a method for tile measurement for use in laying tiles is provided comprising the steps of providing a support member, providing reference means slidably coupled to the support member for establishing a reference position for the device with respect to a tile and another tile, and providing measuring means movably coupled to the support member at a distal end thereof for defining a portion of the other tile relative to the reference position and for permitting the other tile to fit properly adjacent an obstruction after the portion is removed.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
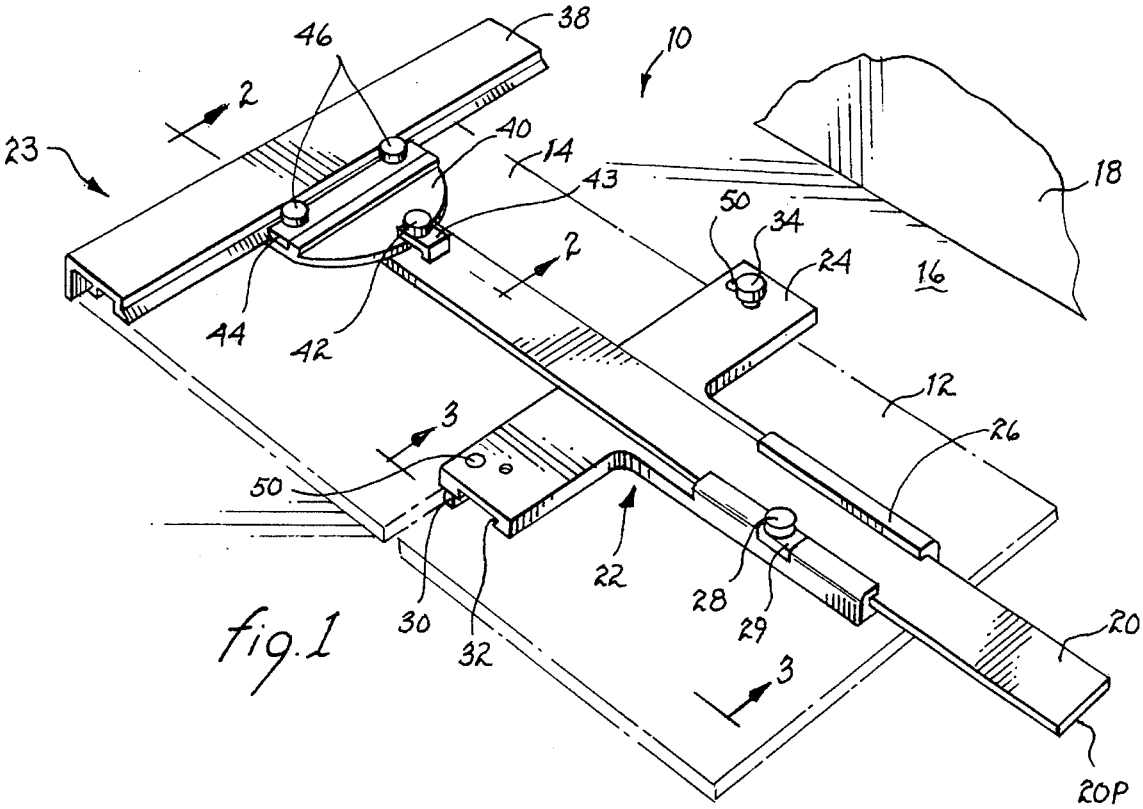
FIG. 1 is a perspective view of the tile measuring device for use in laying tiles.

Referring to FIG. 1, a tile measuring device is shown and is generally designated by reference number 10. A tile 12 and another tile 14 are laid on a floor 16. An obstruction 18 such as a wall or a cabinet is also shown. The tile measuring device 10, or more simply the device, has a support member 20 which supports a reference portion 22 and a measuring portion 23 of the device 10.

The reference portion 22 has a horizontal member portion 24 which is located below and substantially orthogonal to the support member 20. The reference portion 22 has another member portion 26 coupled to the horizontal member portion 24. Note that the member portion 26 is partially located below the support member 20, however, another part of the member portion 26 extends above the support member 20 for slidably retaining the support member 20. A plate 29 and a bolt 28 are coupled to the member portion 26 for fixedly retaining the member portion 26, and thereby the reference portion 22, to the support member 20. The reference portion 22 can be slid from a proximate end 20*p* substantially to a distal end 20*d* (see FIG. 2) of the support member 20. Accordingly, the reference portion 22 can be fixedly retained via the bolt 28 and the plate 29 from the proximate end 20*p* substantially to the distal end 20*d* of the support member 20.

The bottom side of the horizontal member portion 24 has a slot 32 and a spacer bar 30. Both the slot 32 and the spacer bar 30 run along the entire lengthwise dimension of the horizontal member portion 24. The spacer bar 30 is inserted between an edge of tile 12 and an edge of tile 14 in order to form a space therebetween. After the tiles 12 and 14 have adhered to the floor 16, the space therebetween is filled with grout. The horizontal member portion 24 has a bolt 34 inserted therein for locking a gage member 52 (see FIG. 3) within the slot 32.

The measuring portion 23 of the device 10 has a guide member 38 for alignment with an obstruction. The measuring portion 23 also includes a rotatable clamp 40 which is pivotally coupled to the support member 20. The rotatable clamp 40 slidably retains the guide member 38, and the rotatable clamp 40 rotates the guide member 38 for alignment with an obstruction. The rotatable clamp 40 is provided with bolts 46 and a plate 44 for locking the guide member 38 with respect to the rotatable clamp 40. The rotatable clamp 40 is also provided with a bolt 42 and a member 43 for locking the rotatable clamp 40 into a position with respect to the support member 20.

Figure 2:
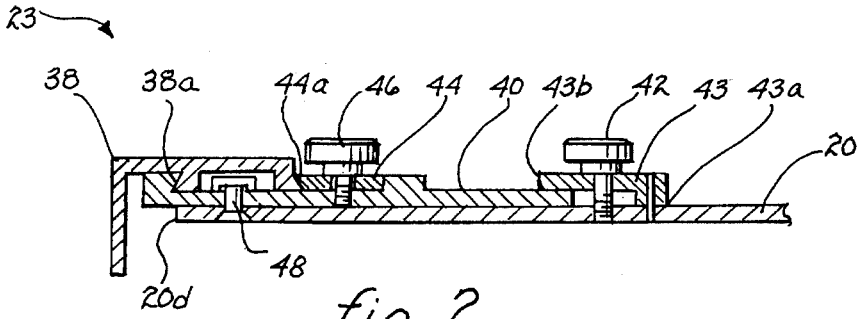
FIG. 2 is a cross sectional view taken along the line 2—2 of FIG. 1.

Referring to FIG. 2, the guide member 38 is connected to the rotatable clamp 40 via the combination of the plate 44, the bolts 46, and angled portions 38*a* and 44*a*. As the bolts 46 (only 1 seen in this view) are loosened, the guide member 38 is permitted to slide in a linear manner along the track formed by angled portions 38*a* and 44*a*. When the guide member 38 has been slid into a desired position, the bolts 46 are tightened in order to lock the guide member 38. The rotatable clamp 40 is pivotally coupled to the support member 20 with a bolt 48. When the bolt 42 is loosened, the rotatable clamp 40 is free to rotate about the bolt 48, thereby rotating the guide member 38 into a desired angular position. When the guide member 38 is in the desired angular position, the bolt 42 is tightened, and, therefore, the member 43 locks the rotatable clamp 40 via contact at surface 43*b*. Note that the member 43 is coupled to the support member 20 at 43*a*. Also, note that when the rotatable clamp 40 is locked into a desired angular position, the guide member 38 is locked into the desired angular position. Thus, the rotatable clamp 40 permits one to both move the guide member 38 in a linear motion and to move the guide member 38 in a rotational motion until the guide member 38 is in a desired position.

Figure 3:
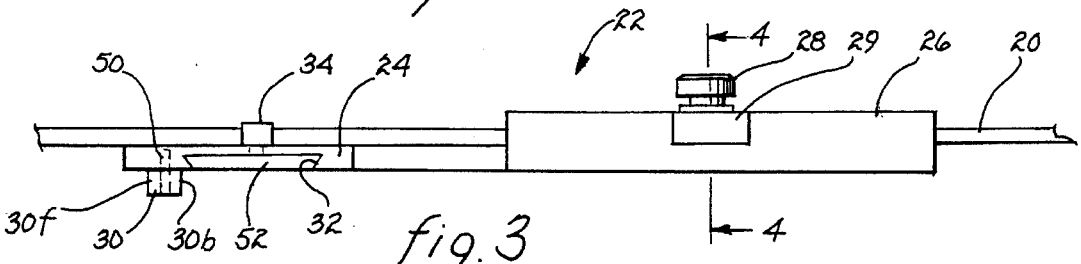
FIG. 3 is a cross sectional view taken along the line 3—3 of FIG. 1.

Referring to FIG. 3, a cross sectional view shows the location of the support member 20 relative to the reference portion 22. Note that the horizontal member portion 24 extends below the support member 20. In FIG. 1, two bolts 50 are shown for connecting the spacer bar 30 to the horizontal member portion 24. One of these two bolts 50 is shown in FIG. 3. The slot 32 is shown to slidably retain gage member 52. The gage member 52 may be slid in both directions along the slot 32, and, therefore, the gage member 52 may be extended from either end of the horizontal member portion 24. Once the gage member 52 has been extended to a desired position, the bolt 34 is tightened in order to lock the gage member 52. In FIG. 1, the bolt 34 is shown near the right end of the horizontal member portion 24, however, note that on the left side of the horizontal member portion 24, there is another hole for a bolt 34. Thus, a single bolt 34 may be used on either the left or the right side of the horizontal member portion 24. Alternatively, one bolt 34 could be used for the left side of the horizontal member portion 24 and another bolt 34 could be used for the right side of the horizontal member portion 24.

Figure 4:
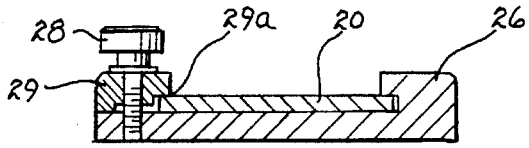
FIG. 4 is a cross sectional view taken along the line 4—4 of FIG. 3.

Referring to FIG. 4, member portion 26 is shown to retain support member 20. The plate 29 is coupled to the member portion 26 such that when the bolt 28 is tightened, the plate 29 clamps down upon surface 29*a* in order to lock the position of the reference portion 22 with respect to the support member 20. Alternatively, the bolt 28 may be loosened in order to permit one to slide the reference portion 22 along the support member 20 until the reference portion 22 is in a desired position whereby one would then lock the reference portion 22 in place.

Figure 7:
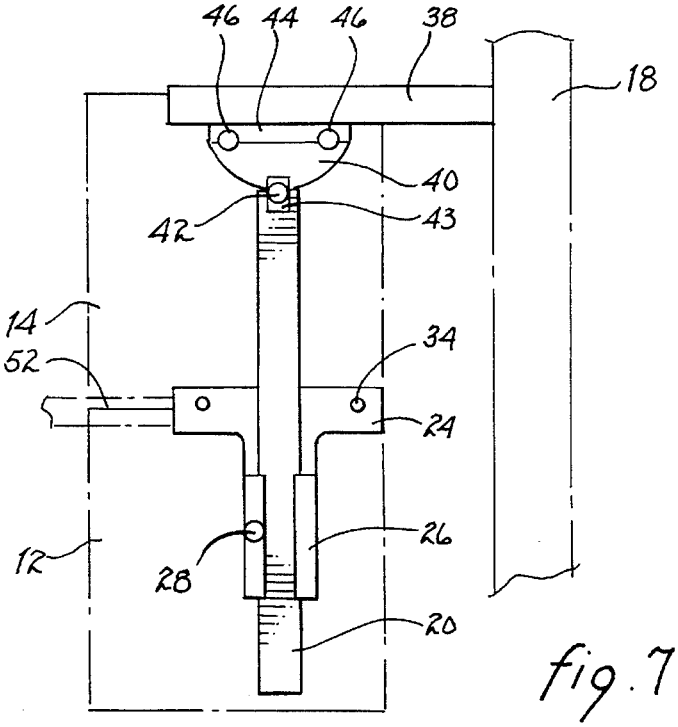
FIG. 7 is a plan view of one of the configurations of the tile measuring device.

Referring to FIG. 7, in order to show some of the possible movements for the device 10, the guide member 38 is shown shifted to the right and the gage member 52 is shown shifted to the left. Obviously, there are many different possible arrangements of an obstruction 18 that may require unusual positions of the device 10, however, since the device 10 can be moved into many different positions, the device 10 is exceptionally useful in conforming to any one of a number of different obstructions. Consequently, a user can quickly and easily custom cut a tile for installation into a difficult location.

OPERATION

Figure 5:
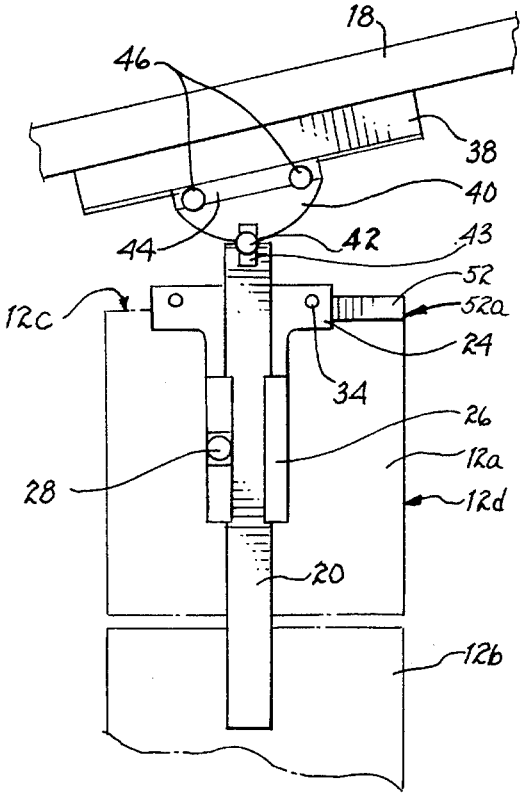
FIG. 5 is a plan view of the tile measuring device set up in a particular reference position with respect to both a tile and an obstruction.
Figure 6:
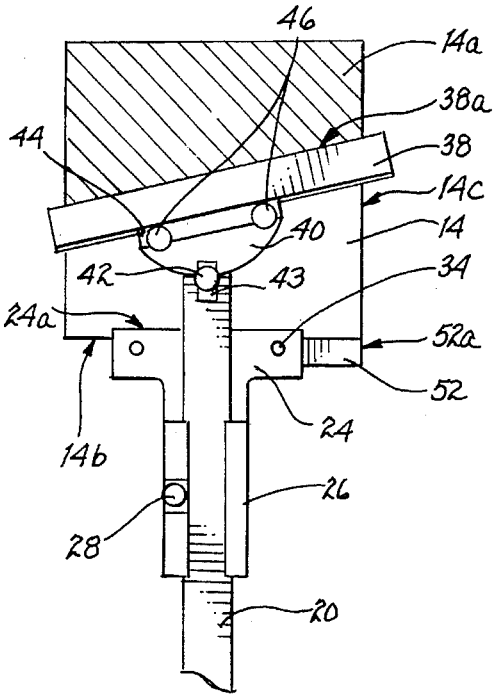
FIG. 6 is a plan view of the tile measuring device set up in the reference position of FIG. 5 in order to cut a tile which will then fit properly with respect to the tile and the obstruction from FIG. 5.

Referring to FIGS. 5 and 6, assume that the tiles 12*a* and 12*b* have already been laid in a manner well known to those skilled in the tiling art. Now, in order to lay a tile in the space between the tile 12*a* and the obstruction 18, one must create a custom tile 14 by removing a portion 14*a* therefrom. The specific structural details of the support member 20, the reference portion 22, and the measuring portion 23 have previously been disclosed, therefore, further detailed description of the mechanics of the device 10 will be limited. Moreover, the manner in which the various structural elements of the device 10 interact in order to permit movement and locking of the device 10 has also been previously disclosed. Thus, no further detailed description of the movement and of the locking of the device 10 is necessary.

Referring to FIG. 5, the spacer bar 30 (not shown in this view) is held with a back edge 30*b* (see FIG. 3) thereof flush against the top edge 12*c* of the tile 12*a*. The support member 20 is slid up through member portion 26 until the guide member 38 is aligned with the obstruction 18. The gage member 52 is extended from the right end of the horizontal member portion 24 until an edge 52*a* of the gage member 52 is aligned with an edge 12*d* of the tile 12*a*. Thus, in this case, the desired reference position is a combination of having the back edge 30*b* of the spacer bar 30 flush against the top edge 12*c* of the tile 12*a*, having the guide member 38 aligned with the obstruction 18 as shown, and having the edge 52*a* of the gage member 52 aligned with the edge 12*d* of the tile 12*a*. With the device 10 in the desired reference position, the bolts 42, 34, and 28 are tightened in order to lock the device 10 into the reference position. In this case, the bolts 46 are already tightened, however, if they were not tightened, then one would tighten them in order to maintain the desired reference position. The aforementioned movements of the device 10 may occur in a different order, however, the device 10 must be properly aligned and then locked into the desired reference position as shown and described.

Referring to FIG. 6, one uses the device 10, which has been locked into the reference position from FIG. 5, to define a portion 14*a* for removal from the tile 14. Specifically, the front edge 30*f* (see FIG. 3) of the spacer bar 30 is held flush against the bottom edge 14*b* of the tile 14, and the edge 52*a* of the gage member 52 aligned with the edge 14*c* of the tile 14. With the device 10 in this reference position relative to the tile 14, one marks tile 14 along the edge 38*a* of the guide member 38. After marking the tile 14, the unwanted portion 14*a* is removed by a cutting process well known to those skilled in the tiling art. Now, the remaining portion of the tile 14 has been custom cut to fit properly between the tile 12*a* and the obstruction 18. Note that this type of custom cut of the tile 14 will provide a grout line between tile 12*a* and tile 14 having a thickness approximately equal to the thickness of the spacer bar 30. Additionally, this type of custom cut of the tile 14 will result in a nearly flush fit between the obstruction 18 and the tile 14. In order to provide a grout line having a thickness approximately equal to the thickness of the spacer bar 30 between the tile 14 and the tile 12*a* and between the tile 14 and the obstruction 18, a similar procedure is implemented, with one exception. Rather than aligning the front edge 30*f* of the spacer bar 30 with the edge 14*b* of the tile 14, one aligns the front edge 24*a* of the horizontal member portion 24 flush with the edge 14*b* of the tile 14.

While the invention has been particularly shown and described with reference to the preferred embodiments thereof, it will be understood by those skilled in the art that the foregoing and other changes in form and details may be made therein without departing from the spirit and scope of the invention. For example, the device 10 could be used to make angled cuts in dry wall construction.

What is claimed is:

1. A tile measuring device for use in laying tiles, comprising, in combination:

a support member;

reference means slidably coupled to said support member for establishing a reference position for said device with respect to a tile and another tile;

measuring means movably coupled to said support member at a distal end thereof for defining a portion of said another title relative to said reference position and for permitting said another title to fit properly adjacent an obstruction after said portion is removed;

wherein said measuring means further comprises:

guide member means for alignment with said obstruction;

rotatable clamping means pivotally coupled to said support member for permitting said guide member means to move lineally with respect to a track formed in said rotatable clamping means and for permitting said guide member means to be rotated about a pivotal connection of said rotatable clamping means to said support member for said alignment with said obstruction;

wherein said rotatable clamping means further comprises:

means for fixedly retaining said rotatable clamping means with said support member; and means for fixedly retaining said guide member means with said rotatable clamping means.

2. The device of claim 1 wherein said reference means is slidable from a proximate end of said support member substantially to said distal end of said support member.

3. The device of claim 2 wherein said reference means further comprises means for fixedly retaining said reference means to said support member at any point from said proximate end substantially to said distal end of said support member.

4. The device of claim 1 wherein said reference means further comprises:

a horizontal member portion located substantially orthogonal to said support member and having a slot therein; and spacer bar means extending from said horizontal member portion for insertion between an edge of said tile and an edge of said another tile.

5. The device of claim 4 wherein said reference means further comprises:

gage member means slidably retained within said slot for extension from said horizontal member portion; and gage member retaining means coupled to said horizontal member portion for locking said gage member means in place.

6. The device of claim 5 wherein said slot is provided on a bottom side of said horizontal member portion and said slot extends along the full length of said horizontal member portion.

7. The device of claim 5 wherein said gage member means is extendable from both a first end and a second end of said horizontal member portion.

8. The device of claim 1 wherein said reference means comprises:

means for fixedly retaining said reference means to said support member at any point from a proximate end substantially to said distal end of said support member;

a horizontal member portion located substantially orthogonal to said support member and having a slot therein;

spacer bar means extending from said horizontal portion for insertion between an edge of said tile and an edge of said another tile;

gage member means slidably retained within said slot for extension from both a first end and a second end of said horizontal member portion; and gage member retaining means coupled to said horizontal member portion for locking said gage member means in place.

9. A method for use in laying tiles comprising the steps of:

providing a support member;

providing reference means slidably coupled to said support member for establishing a reference position for said device with respect to a tile and another tile;

providing measuring means movably coupled to said support member at a distal end thereof for defining a portion of said another title relative to said reference position and for permitting said another title to fit properly adjacent an obstruction after said portion is removed;

wherein the step of providing said measuring means further comprises the steps of:

providing guide member means for alignment with said obstruction;

providing rotatable clamping means pivotally coupled to said support member for permitting said guide member means to move lineally with respect to a track formed in said rotatable clamping means and for permitting said guide member means to be rotated about a pivotal connection of said rotatable clamping means to said support member for said alignment with said obstruction;

wherein the step of providing said rotatable clamping means further comprises the steps of:

providing means for fixedly retaining said rotatable clamping means with said support member; and providing means for fixedly retaining said guide member means with said rotatable clamping means.

10. The method of claim 9 wherein said reference means is slidable from a proximate end of said support member substantially to said distal end of said support member.

11. The method of claim 10 wherein the step of providing said reference means further comprises the steps of providing means for fixedly retaining said reference means to said support member at any point from said proximate end substantially to said distal end of said support member.

12. The method of claim 9 wherein the step of providing said reference means further comprises the steps of:

providing a horizontal member portion located substantially orthogonal to said support member and having a slot therein; and providing spacer bar means extending from said horizontal member portion for insertion between an edge of said tile and an edge of said another tile.

13. The method of claim 12 wherein the step of providing said reference means further comprises the steps of:

providing gage member means slidably retained within said slot for extension from said horizontal member portion; and providing gage member retaining means coupled to said horizontal member portion for locking said gage member means in place.

14. The method of claim 13 wherein said slot is provided on a bottom side of said horizontal member portion and said slot extends along the full length of said horizontal member portion.

15. The method of claim 13 wherein said gage member means is extendable from both a first end and a second end of said horizontal member portion.

16. A tile measuring device for use in laying tiles, comprising, in combination:

a support member;

reference means slidably coupled to said support member for establishing a reference position for said device with respect to a first tile and another tile;

measuring means movably coupled to said support member at a distal end thereof for defining a portion of said another title relative to said reference position and for permitting said another title to fit properly adjacent an obstruction after said portion is removed;

said reference means including a horizontal member portion located substantially orthogonal to said support member and having a slot therein;

spacer bar means extending from said horizontal portion for insertion between an edge of said first tile and an edge of said another tile;

gage member means slidably retained within said slot for extension from said horizontal member portion for defining a repeatable reference position between said first tile and said another tile when measuring for said another tile; and gage member retaining means coupled to said horizontal member portion for locking said gage member means in place.

* * * * *